US008920003B2

(12) United States Patent
Cheng et al.

(10) Patent No.: US 8,920,003 B2
(45) Date of Patent: Dec. 30, 2014

(54) TELESCOPIC LUMINAIRE

(75) Inventors: Shun-Chung Cheng, Taipei (TW); Chih-Huang Wang, Taipei (TW); Chang-Ming Cheng, Taipei (TW)

(73) Assignees: Lite-On Electronics (Guangzhou) Limited, Guangzhou (CN); Lite-On Technology Corp., Taipei (TW)

( * ) Notice: Subject to any disclaimer, the term of this patent is extended or adjusted under 35 U.S.C. 154(b) by 414 days.

(21) Appl. No.: 13/326,415

(22) Filed: Dec. 15, 2011

(65) Prior Publication Data

US 2012/0236580 A1 Sep. 20, 2012

(30) Foreign Application Priority Data

Mar. 16, 2011 (CN) ..... 2011 2 0071311 U

(51) Int. Cl.

| | |
|---|---|
| ***F21V 21/22*** | (2006.01) |
| ***F21V 21/002*** | (2006.01) |
| ***F21V 29/00*** | (2006.01) |
| ***F21V 23/06*** | (2006.01) |

(52) U.S. Cl.

CPC ..... *F21V 21/002* (2013.01); *F21V 29/00* (2013.01); *F21V 21/22* (2013.01); *F21V 23/06* (2013.01)

USPC ..... 362/364; 362/365; 362/366; 362/367; 362/368; 362/369; 362/370; 362/371; 362/372; 362/373; 362/387; 362/418; 362/429; 362/430

(58) Field of Classification Search

CPC ..... F21V 27/00; F21V 21/22; F21V 21/16; F21V 21/18; F21V 27/02; F21S 8/026

USPC ..... 362/364–373, 387, 418, 429, 430

See application file for complete search history.

(56) References Cited

U.S. PATENT DOCUMENTS

| | | | | |
|---|---|---|---|---|
| 7,775,691 | B2 * | 8/2010 | Burgei et al. | 362/386 |
| 2011/0075423 | A1 * | 3/2011 | Van De Ven | 362/249.02 |

* cited by examiner

*Primary Examiner* — William Carter

(74) *Attorney, Agent, or Firm* — Rosenberg, Klein & Lee

(57) ABSTRACT

A luminaire includes a first body module, a light module, a second body module, a wire-receiving unit, and a wire. The light module is disposed on said first body module. The second body module is movable telescopically relative to the first body module. The wire has two ends respectively and electrically connected to the first and second body modules, and a portion that is received within the wire-receiving unit and that is movable at least partially into or out of the wire-receiving unit as a result of adjusting the length of the luminaire, thereby preventing entanglement of the wire.

20 Claims, 12 Drawing Sheets

TELESCOPIC LUMINAIRE

CROSS-REFERENCE TO RELATED APPLICATION

This application claims priority of Chinese Application No. 201120071311.9, filed on Mar. 16, 2011.

BACKGROUND OF THE INVENTION

1. Field of the Invention

This invention relates to a luminaire, and more particularly to a length-adjustable luminaire.

2. Description of the Related Art

A recessed light includes a lamp holder inserted into a ceiling, and a lamp disposed on the lamp holder. When the lamp holder and the lamp have different lengths, appearance and light-emitting efficiency of the recessed light are influenced adversely.

To solve the different length problem, a length-adjustable luminaire has been proposed. However, another problem is encountered by the length-adjustable luminaire. That is, a wire in the length-adjustable luminaire is loosened when not in a maximum-length state. In this state, the wire is easily entangled.

SUMMARY OF THE INVENTION

An object of this invention is to provide a luminaire that includes a wire, which can be maintained in a tensioned state so as to prevent entanglement of the wire in the luminaire.

Another object of this invention is to provide a length-adjustable luminaire.

According to this invention, a luminaire includes a first body module, a light module, a second body module, a wire-receiving unit, and a wire. The light module is disposed on the first body module. The second body module is movable telescopically relative to the first body module. The wire has two ends respectively and electrically connected to the first and second body modules, and a portion that is received within the wire-receiving unit and that is movable at least partially into or out of the wire-receiving unit as a result of adjusting the length of the luminaire, thereby preventing entanglement of the wire.

BRIEF DESCRIPTION OF THE DRAWINGS

These and other features and advantages of this invention will become apparent in the following detailed description of two preferred embodiments of this invention, with reference to the accompanying drawings, in which.

DETAILED DESCRIPTION OF THE PREFERRED EMBODIMENTS

Figure 1:
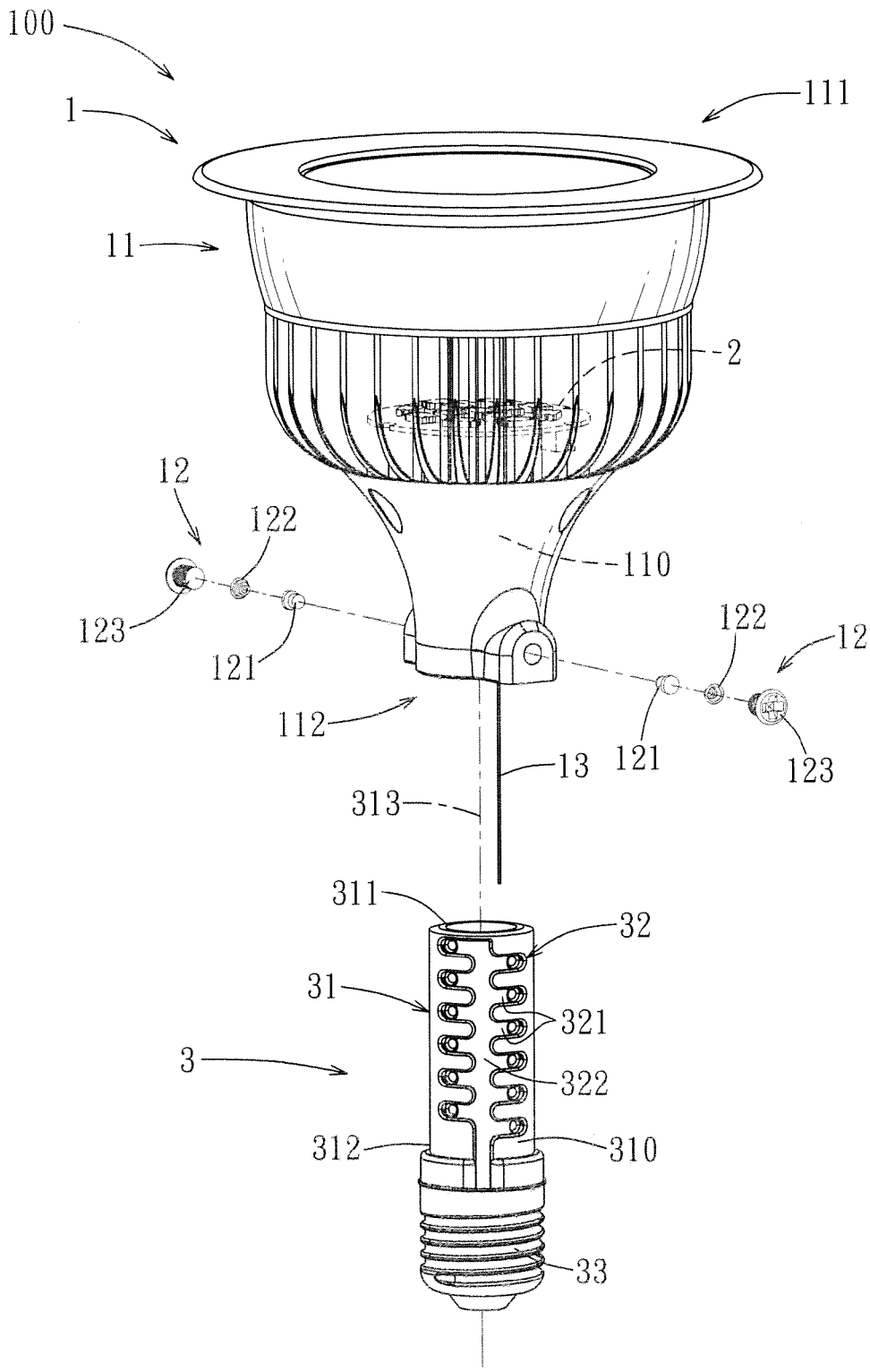
FIG. 1 is a partly exploded perspective view of the first preferred embodiment of a luminaire according to this invention.
Figure 2:
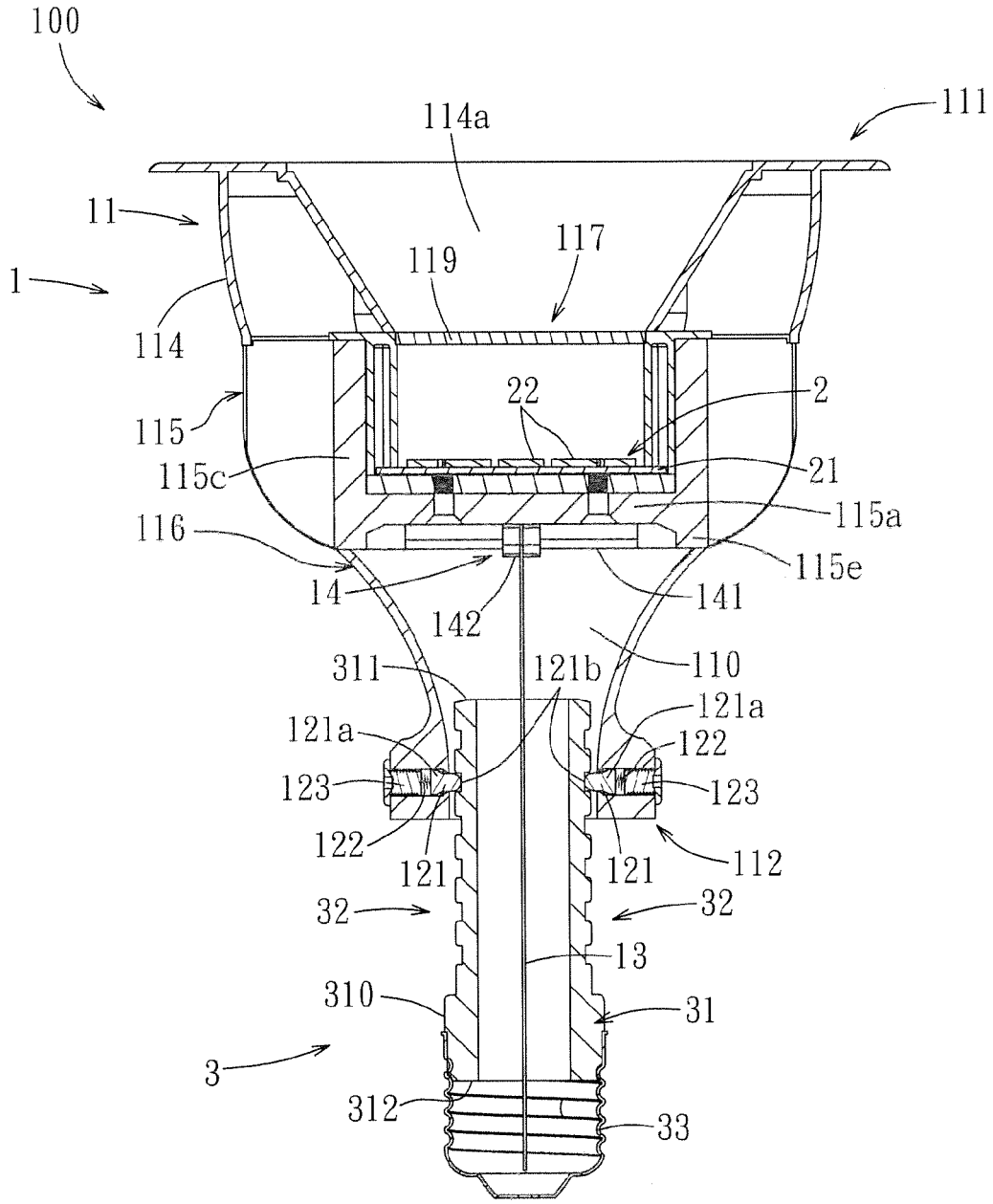
FIG. 2 is a sectional side view of the first preferred embodiment.

Referring to FIGS. 1 and 2, the first preferred embodiment of a luminaire 100 according to this invention includes a first body module 1, a light module 2, a second body module 3, a wire 13, and a wire-receiving unit 14.

The first body module 1 includes a first body unit 11 and a pair of positioning projection units 12. The first body unit 11 has opposite first and second sides 111, 112. The first side 111 has an opening (114*a*). The second side 112 is formed with a cavity 110. The positioning projection units 12 are disposed on the first body unit 11.

Figure 3:
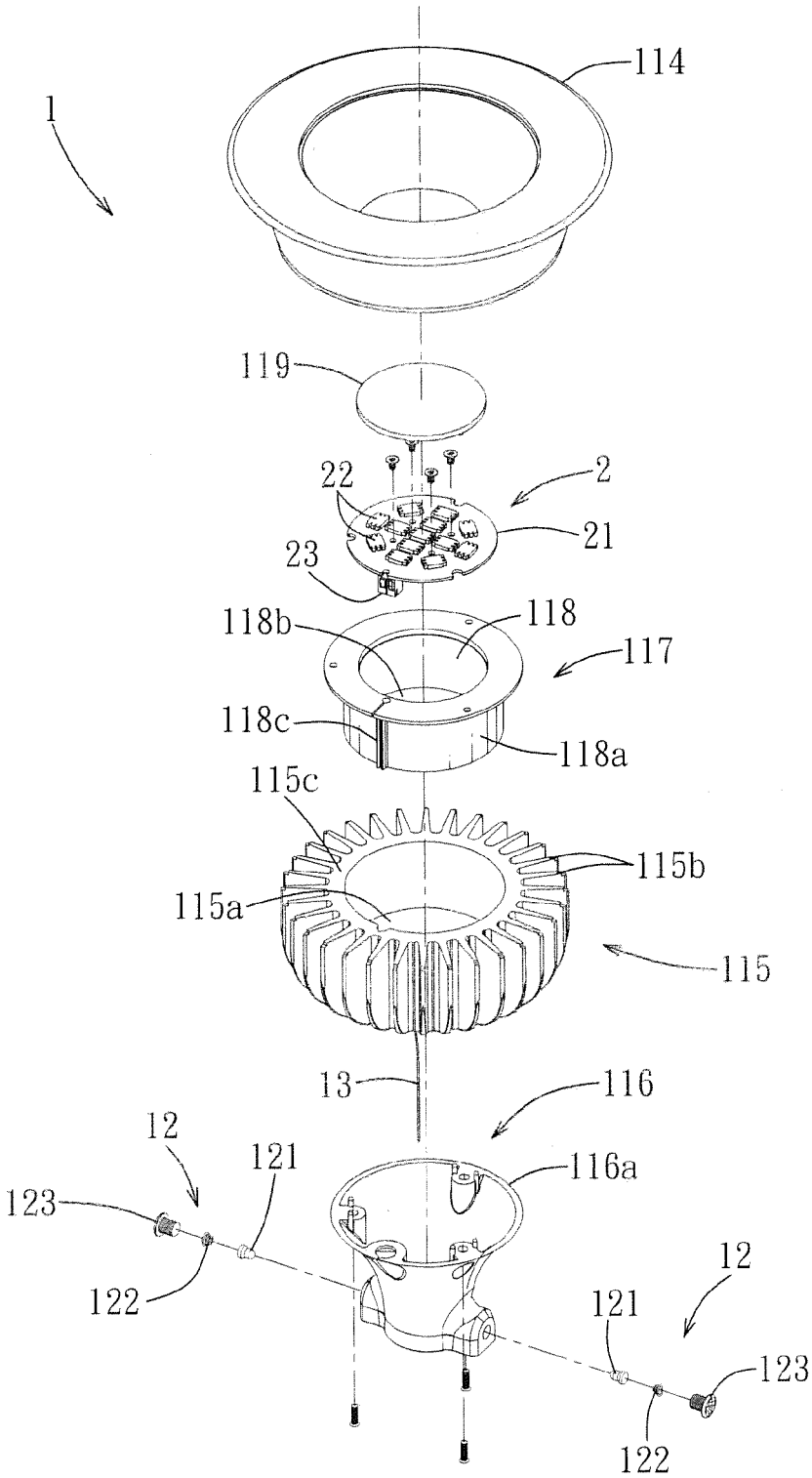
FIG. 3 is an exploded perspective view of a first body module of the first preferred embodiment.
Figure 4:
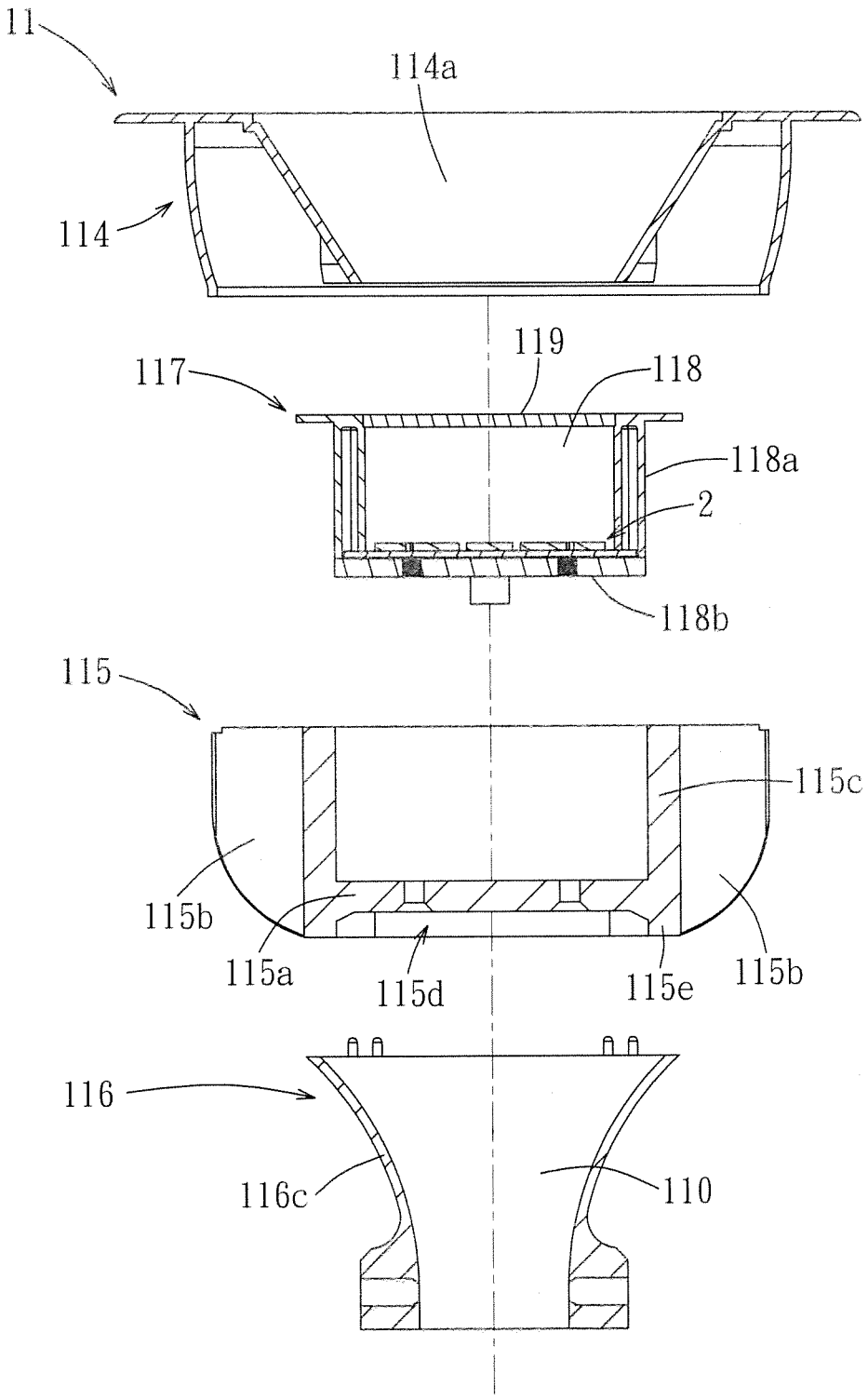
FIG. 4 is an exploded sectional view of the first body module of the first preferred embodiment.

With further reference to FIGS. 3 and 4, the first body unit 11 includes a base 116, a light module holder 117, a heat sink 115, and a lamp cover 114. The light module holder 117 is connected removably to the heat sink 115. The heat ink 115 is connected between the lamp cover 114 and the base 116, such that the base 116 is disposed under the lamp cover 114. The lamp cover 114 defines the first side 111 of the first body unit 11. The lamp cover 114 defines the opening (114*a*). In this embodiment, the opening (114*a*) is frustoconical. The base 116 defines the second side 112 of the first body unit 11.

In this embodiment, the base 116 is a hollow tube. The heat sink 115 includes a heat sink bottom wall (115*a*), a heat sink peripheral wall (115*c*) extending upwardly from the heat sink bottom wall (115*a*), an extension peripheral wall (115*e*) extending downwardly from the heat sink bottom wall (115*a*), and a plurality of heat dissipating fins (115*b*) extending radially and outwardly from the heat sink peripheral wall (115*c*). The extension peripheral wall (115*e*) cooperates with the heat sink bottom wall (115*a*) to define a bottom recess (115*d*). The base 116 includes a peripheral wall (116*a*) defining the cavity 110. The peripheral wall (116*a*) is connected to the extension peripheral wall (115*e*). The light module holder 117 is disposed fixedly on a top surface of the heat sink bottom wall (115*a*), and is surrounded by the heat sink peripheral wall (115*c*). The light module holder 117 includes a holder bottom wall (118*b*), a holder surrounding wall (118*a*) extending upwardly from the holder bottom wall (118*b*), and a transparent plate 119 connected to the holder surrounding wall (118*a*) and spaced apart from the holder bottom wall (118*b*). The holder bottom wall (118*b*) cooperates with the holder surrounding wall (118*a*) to define an accommodating space 118 for receiving the light module 2. The lamp cover 114 is connected to a top portion of the heat sink 115. The transparent plate 119 is exposed within the opening (114*a*) in the lamp cover 114.

The positioning projection units 12 are disposed respectively on two opposite sides of the peripheral wall (116*a*) of the base 116. Each of the positioning projection units 12 includes a projecting rod 121, a resilient member 122, and a bolt 123. The bolts 123 of the positioning projection units 12 are threaded to the peripheral wall (116*a*) of the base 116. The projecting rod 121 of each of the positioning projection units 12 has a head (121*a*) and a distal end (121*b*) (see FIG. 2). The resilient member 122 of each of the positioning projection units 12 is a coiled compression spring, and is disposed between and abuts against the corresponding projecting rod 121 and the corresponding bolt 123 for biasing the distal end (121*b*) of the corresponding projecting rod 121 into the cavity 110. The heads (121*a*) of the projecting rods 121 are confined within the peripheral wall (116*a*) of the base 116, as shown in FIG. 2.

The light module 2 includes a circuit board 21 disposed on the light module holder 117, and a plurality of light-emitting members 22 disposed on the circuit board 21. In this embodiment, the light-emitting members 22 are light emitting diodes (LEDs). The light-emitting members 22 emit light toward the transparent plate 119, i.e., toward the opening (114*a*) in the lamp cover 114.

The light module holder 117 and the light module 2 are assembled in a modular manner. An assembly of the light module holder 117 and the light module 2 can be removed from the heat sink 115 for replacement. In this manner, the color of the light emitted from the light module 2 and the temperature of the light module 2 can be changed according to user's need. The connection structure between the light module holder 117 and the heat sink 115 will be described hereinafter.

The second body module 3 includes a second body unit 31, a pair of positioning groove units 32 formed respectively in two opposite sides of the second body unit 31, and a conductive connector 33. The second body unit 31 has a first end 311 and a second end 312. Preferably, the second body unit 31 is configured as an upright cylindrical tube, extends along an axial direction 313, and has an outer surface 310. The first and second ends 311, 312 are opposite to each other along the axial direction 313. The positioning groove units 32 are formed in the outer surface 310. The conductive connector 33 is disposed on the second end 312 of the second body unit 31.

Each of the positioning groove units 32 includes a plurality of positioning grooves 321 formed in the outer surface 310 of the second body unit 31 and arranged along the axial direction 313, and a slide slot 322 extending along the axial direction 313 and in spatial communication with the positioning grooves 321. Each of the positioning grooves 321 extends along a circumferential direction of the second body unit 32 by an angle that is but not limited to about 43 degrees as long as each of the positioning grooves 321 of one of the positioning groove units 32 is not in spatial communication with any of the positioning grooves 321 of the other one of the positioning groove units 32. The positioning grooves 321 and the slide slot 322 of each of the positioning groove units 32 are arranged in a manner simulating tree branches and a tree trunk. In other words, the positioning grooves 321 of each of the positioning groove units 32 extend from two opposite sides of the corresponding slide slot 322. The positioning grooves 321 of each of the positioning groove units 32 at a left side of the corresponding slide slot 322 are arranged alternately with those at a right side of the corresponding slide slot 322. That is, each of the positioning grooves 321 at the left side is disposed between two adjacent ones of the positioning grooves 321 at the right side in a vertical direction. Any two adjacent positioning grooves 321 of each of the positioning groove units 32 at the same side of the corresponding slide slot 322 are spaced apart from each other by a vertical distance that can be between 2.5 and 4.5 mm. In this embodiment, the vertical distance is 2.5 mm.

It should be noted that, in this embodiment, extension of the positioning grooves 321 of each of the positioning groove units 32 from two opposite sides of the corresponding slide slot 322 is advantageous in that, the number of the positioning grooves 321 of different lengths is increased significantly. In an alternative arrangement, the positioning grooves 321 of each of the positioning groove units 32 may extend from a single side of the corresponding slide slot 322.

Figure 5:
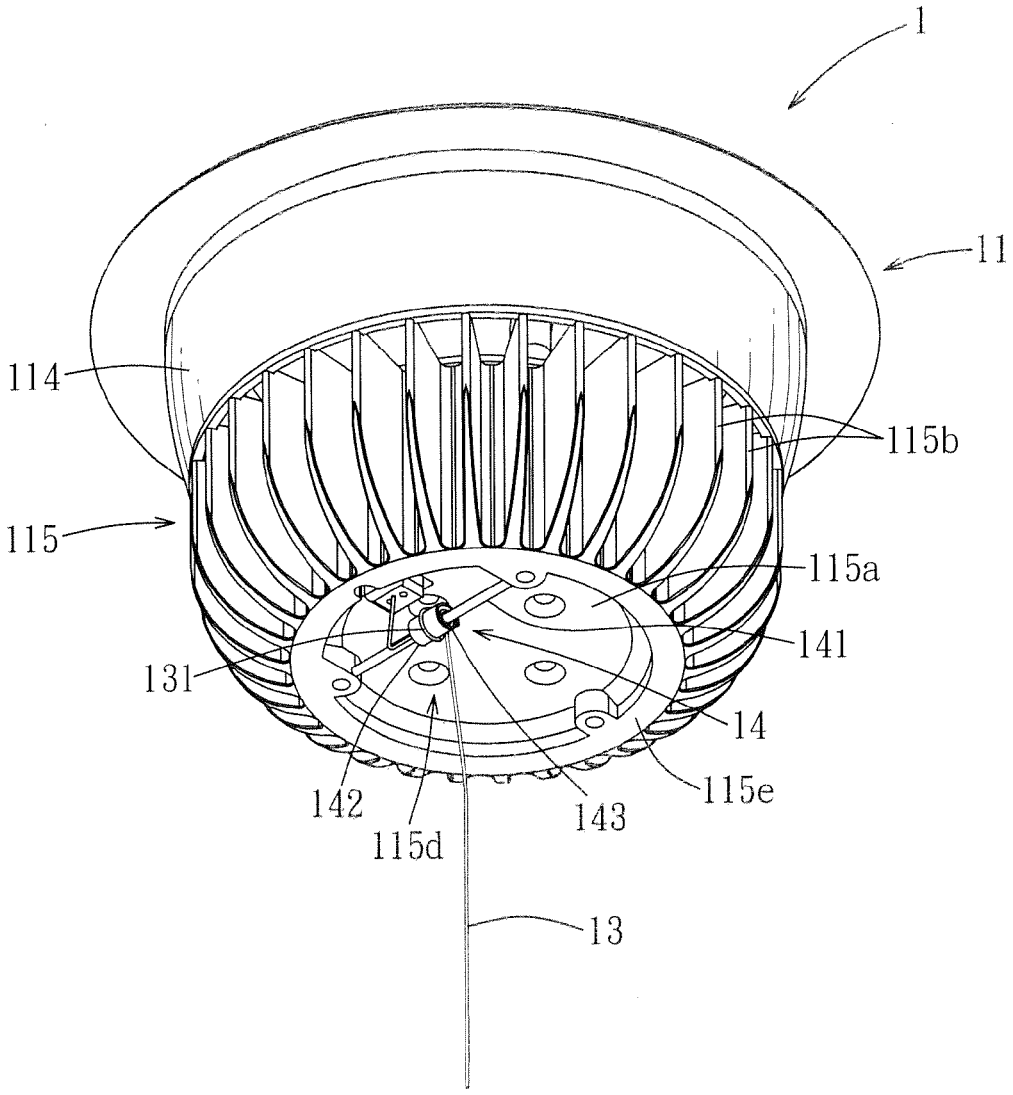
FIG. 5 is a fragmentary perspective view of the first preferred embodiment.

With particular reference to FIGS. 2 and 5, the wire 13 is disposed between the first and second body units 11, 31, and has an upper end extending into the first body unit 11 to electrically connect with the light module 2, and a lower end electrically connected to the second body module 3. The wire-receiving unit 14 is disposed on the first body unit 11, and includes a shaft rod 141 and a torsion spring 142. The shaft rod 141 has two ends connected fixedly to the extension peripheral wall (115*e*) of the heat sink 115 and disposed in the bottom recess (115*d*), i.e., on a bottom side of the heat sink bottom wall (115*a*) facing away from the light module holder 117. Preferably, the torsion spring 142 is a spiral spring, and has an inner end 143 fastened to the shaft rod 141. The wire 13 has an intermediate portion 131 wound around the torsion spring 142 such that, when a pulling force is applied to the wire 13, the intermediate portion 131 of the wire 13 is unwound from the torsion spring 142. When the pulling force is released, the intermediate portion 131 of the wire 13 is wound again back onto the torsion spring 142.

Figure 6:
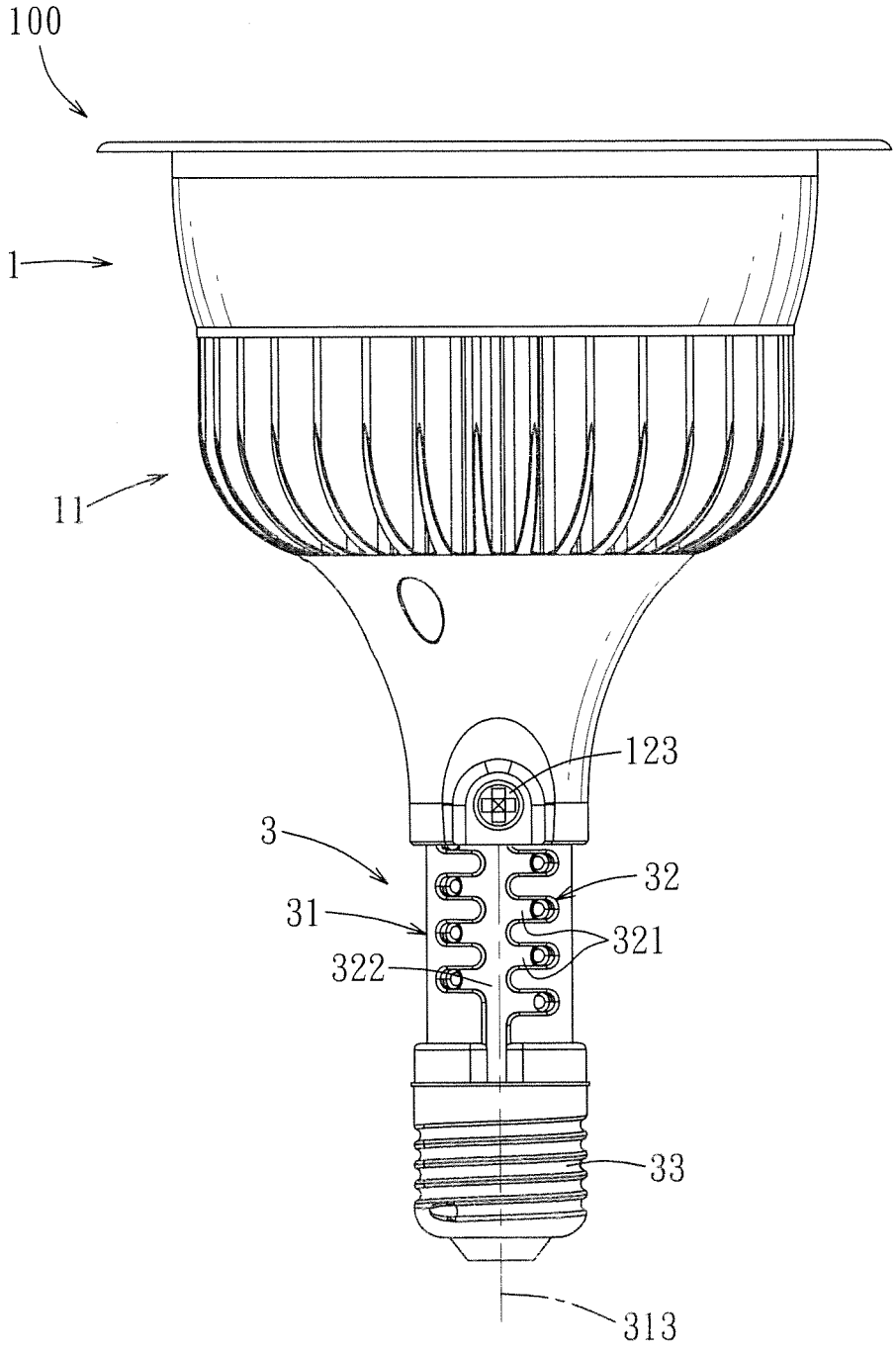
FIG. 6 is a side view of the first preferred embodiment, illustrating that a positioning projection unit is disposed in a slide slot so as to allow for relative telescopic movement between the first body module and a second body module.

With particular reference to FIGS. 2 and 6, during assembly of the first and second body modules 1, 3, the first end 311 of the second body unit 31 is inserted into the cavity 110 in the first body unit 11, so that the distal ends (121*b*) of the projecting rods 121 are extended slidably into the two positioning groove units 32 of the second body module 3, respectively. Movement of the distal ends (121*b*) of the projecting rods 121 within the slide slots 322 results in a relative telescopic movement between the first and second body units 11, 31. In other words, the second end 312 of the second body unit 31 can be moved upwardly toward or downwardly away from the first body unit 11 to reduce or increase the total height of the first and second body modules 1, 3 (i.e., the total height of the luminaire 100).

Figure 7:
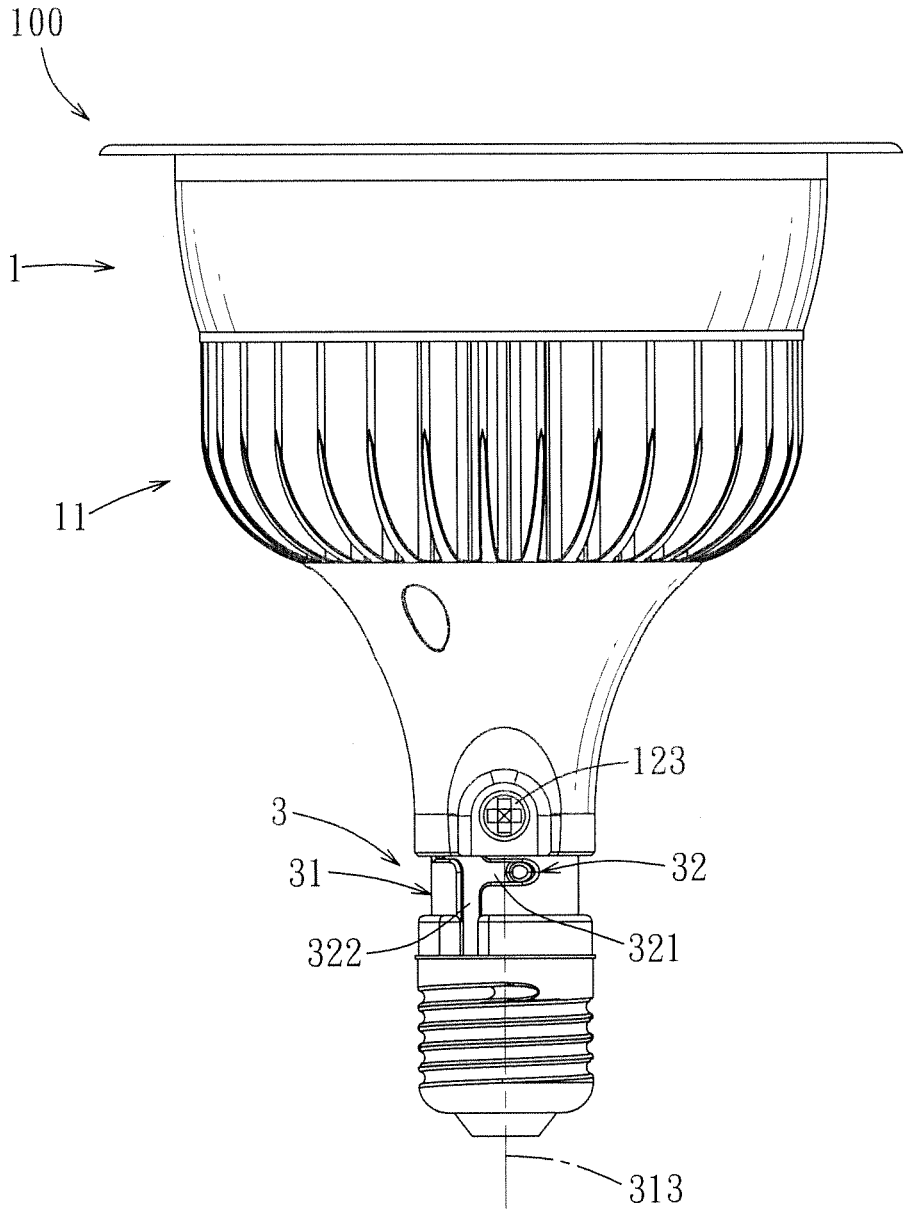
FIG. 7 is a view similar to FIG. 6 but illustrating that the positioning projection unit is disposed in a positioning groove so as to prevent the relative telescopic movement between the first and second body modules.

With particular reference to FIGS. 2 and 7, the function of the positioning grooves 321 will be described. When the second body unit 31 is moved relative to the first body unit 11 to a desired height, it is rotated relative to the same by an angle to allow the projecting rods 121 to be moved into the positioning grooves 321 corresponding to the desired height, thereby maintaining the relative position between the first and second body units 11, 31 (i.e., preventing the relative telescopic movement between the first and second body units 11, 31). In this manner, the total height of the first and second body modules 1, 3 can be fixed. As such, the positioning grooves 321 arranged along the axial direction 313 are provided for allowing the projecting rods 121 to be inserted thereinto, so as to prevent the relative telescopic movement between the first and second body units 11, 31.

Since the upper and lower ends of the wire 13 are connected respectively to the first and second body modules 1, 3, when the second end 312 of the second body unit 31 is moved downwardly away from the first body unit 31, a pulling force is applied to the lower and of the wire 13 connected to the conductive connector 33 to thereby unwind the intermediate portion 131 of the wire 13 from the torsion spring 143. At the same time, the torsion spring 142 stores a return force so that, subsequently, when the second end 312 of the second body unit 31 is moved upwardly toward the first body unit 11, the pulling force is released to wind the intermediate portion 131 of the wire 13 around the torsion spring 142 due to the return force, thereby reducing the total height of the first and second body modules 1, 3. As such, due to the presence of the wire-receiving unit 14, the wire 13 can be maintained in a tensioned state during the relative telescopic movement between the first and second body modules 1, 3. In this manner, entanglement of the wire 13 can be prevented. The torsion spring 142 of the wire-receiving unit 14 can be connected to the wire 13 in a manner simulating a spinning reel.

To maintain stably the distal ends (121*b*) of the projecting rods 121 within the positioning grooves 321, in this embodiment, each of the positioning grooves 321 has a deepened distal end (i.e., an end distal from the corresponding slide slot 322). For example, the distal ends have a depth of 3.5 mm, and the remaining portions of the positioning grooves 321 have a depth of 3 mm. Since the projecting rods 121 are biased by the resilient members 122, when the distal ends (121*b*) of the projecting rods 121 are in the slide slots 322, the resilient members 122 are subjected to a pre-pressing force. When the distal ends (121*b*) of the projecting rods 121 are moved respectively into the distal ends of two of the positioning grooves 321, since the distal ends of the positioning grooves 321 are deeper than the remaining portions of the positioning grooves 321, the resilient members 122 are stretched. As a result, when removal of the distal ends (121*b*) of the projecting rods 121 from the distal ends of the two positioning grooves 321 is desired, it is necessary to apply a relatively large torsion force to overcome the biasing force of the resilient members 122 (i.e., to compress the resilient members 122), so as to rotate the second body unit 31 relative to the first body unit 11. Due to this design, undesired relative telescopic movement between the first and second body units 11, 31 can be avoided.

Figure 8:
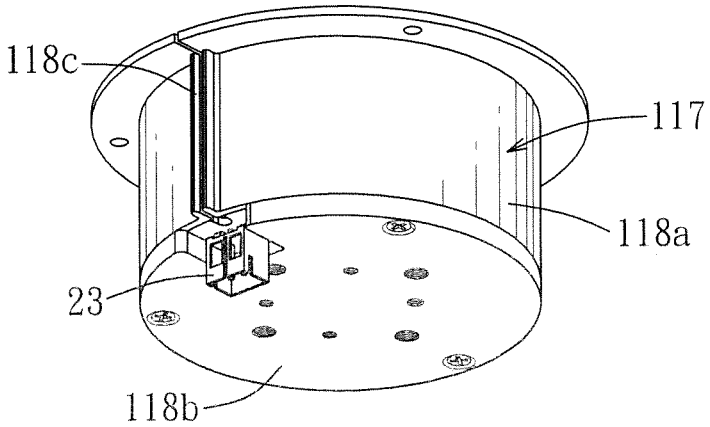
FIG. 8 is a perspective view of a light module holder of the first preferred embodiment.
Figure 9:
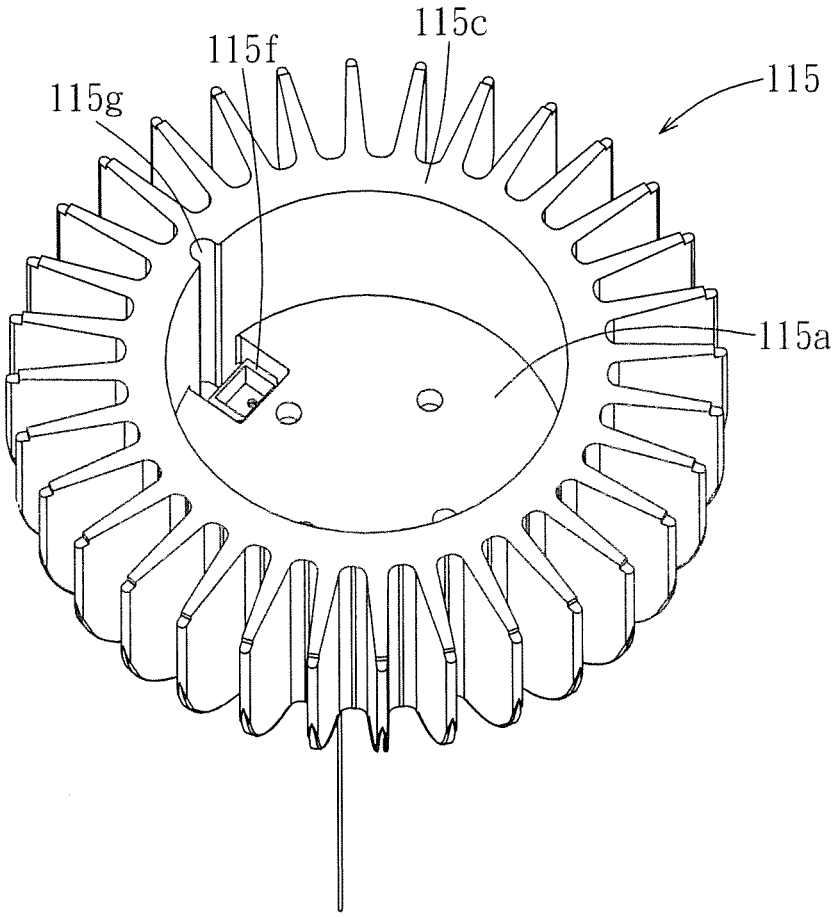
FIG. 9 is a perspective view of a heat sink of the first preferred embodiment.

With particular reference to FIGS. 3, 8, and 9, removable connection between the light module holder 117 and the heat sink 115 will be described. The light module 2 further includes a plug connector 23 disposed on the circuit board 21 and outwardly of the holder bottom wall (118*b*) of the light module holder 117. The light-emitting members 22 are electrically connected to the plug connector 23. The light module holder 117 further includes a rib (118*c*) projecting from an outer wall surface of the holder surrounding wall (118*a*). The heat sink 115 further includes a socket connector (115*f*) disposed on the heat sink bottom wall (115*a*). The lower end of the wire 13 is electrically connected to the socket connector (115*f*). As such, the wire 13 is connected to the conductive connector 33 at the lower end thereof, is wound around the torsion spring 142 at the intermediate portion 131, and is connected to the socket connector (115) at the other end thereof. The heat sink peripheral wall (115*c*) is formed with a vertical guide slot (115*g*). When it is desired to assemble the light module holder 117 to the heat sink 115, the rib (118*c*) of the light module holder 117 is moved into the guide slot (115*g*) in the heat sink peripheral wall (115*c*) until the plug connector 23 is inserted into the socket connector (115*f*). Subsequently, the holder bottom wall (118*b*) of the light module holder 117 is locked on the heat sink bottom wall (115*a*) by lock bolts.

In view of the above, the wire entanglement problem associated with the above-mentioned prior art can be solved by providing the wire-receiving unit 14. Furthermore, since the light module holder 117 is removable, the light module 2 is convenient to remove and replace. Further, through cooperation between the projecting rods 121 of the first body module 1 and the positioning groove units 32 of the second body module 3, the second body unit 31 is movable telescopically relative to the first body unit 11 to change the total height of the luminaire 100.

Figure 10:
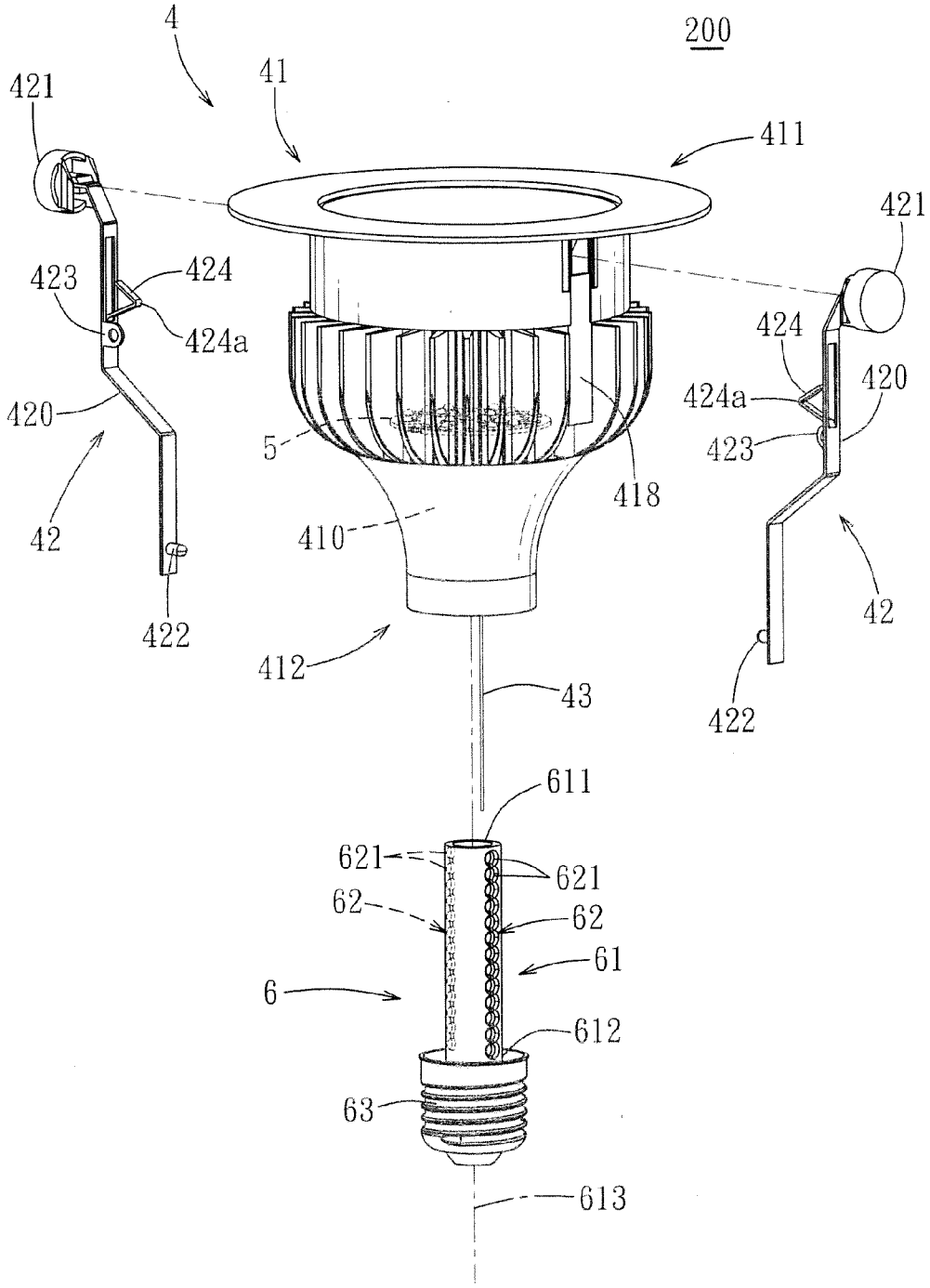
FIG. 10 is a partly exploded perspective view of the second preferred embodiment of a luminaire according to this invention.
Figure 11:
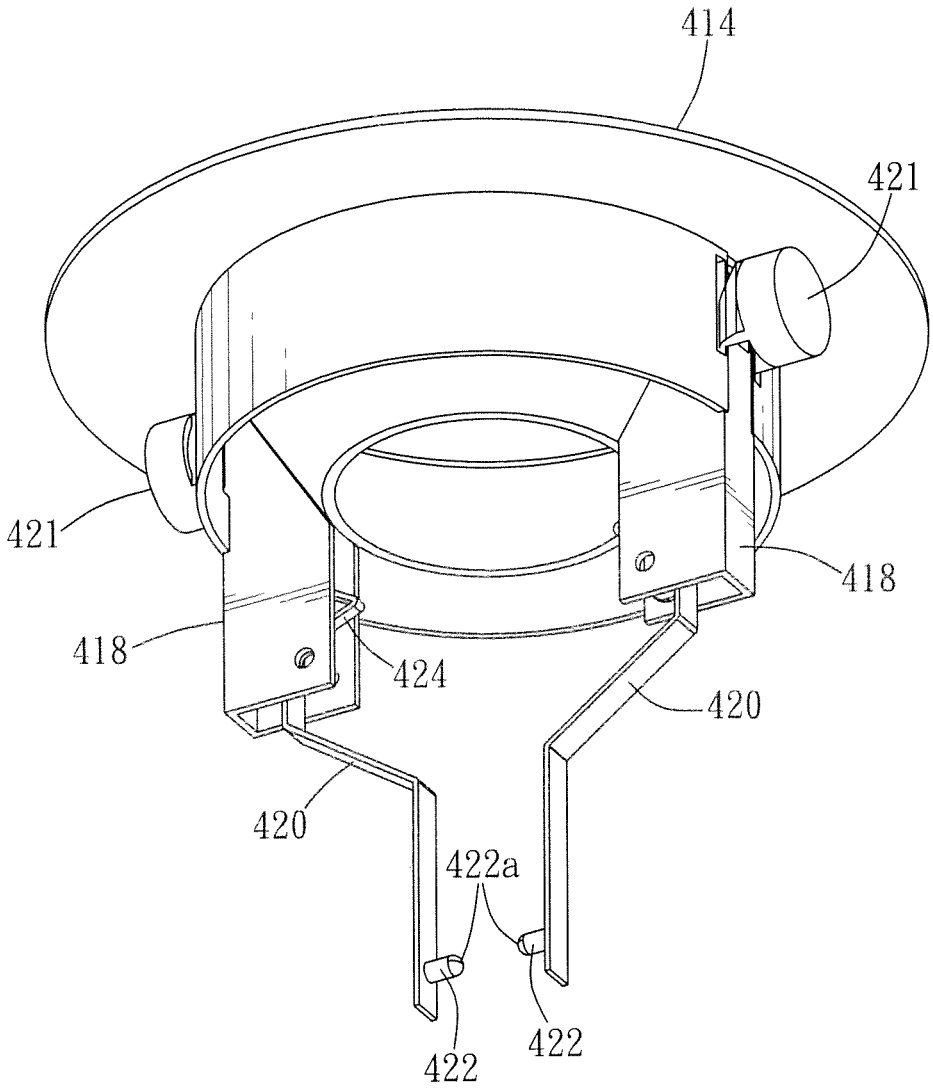
FIG. 11 is a perspective view of two retaining arms of a first body module of the second preferred embodiment.
Figure 12:
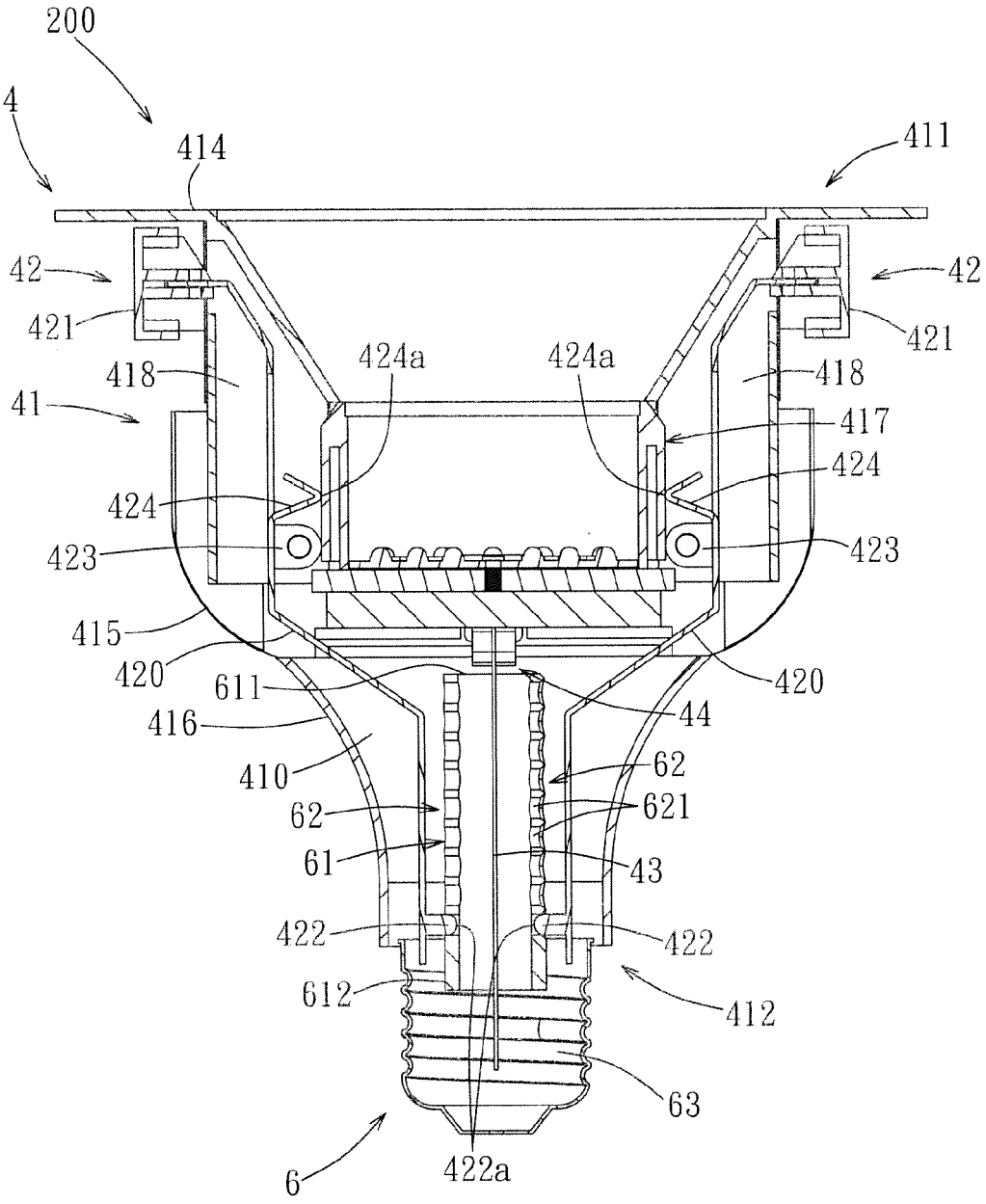
FIG. 12 is a sectional side view of the second preferred embodiment.

Referring to FIGS. 10 to 12, the second preferred embodiment of a luminaire 200 according to this invention includes a first body module 4, a light module 5, a second body module 6, a wire 43, and a wire-receiving unit 94.

The first body module 4 includes a first body unit 41, a pair of retaining arms 42, and a pair of positioning projection units 422 disposed respectively on the retaining arms 42. The light module holder 117, the heat sink 415, and the base 416 are similar in construction to those of the previous embodiment. The connection and operation of the wire-receiving unit 14 and the wire 33 are the same as those of the previous embodiment. The difference resides in the structure of the lamp cover 414. In this embodiment, the lamp cover 414 is provided with two spaced-apart extension arms 418 extending downwardly therefrom.

Each of the retaining arms 42 includes an arm body 420, and an actuating portion 421 configured as a cap-shaped pushbutton and disposed on one end of the arm body 420. Each of the positioning projection units 422 is configured as a projecting rod extending from the other end of the corresponding arm body 420. Each of the retaining arms 42 further includes a lug or pivot portion 423 disposed between the actuating portion 421 and the positioning projection unit 422, and a resilient portion 424 connected to the arm body 420 and disposed between the actuating portion 421 and the pivot portion 423. The resilient portion 424 of each of the retaining arms 42 is a V-shaped plate, and has a tip (424*a*). In practice, the arm body 420, the resilient portion 424, and the pivot portion 423 of each of the retaining arms 42 can be formed from a metal plate by a stamping process.

The retaining arms 42 are disposed respectively on two opposite sides of the first body unit 41, and are disposed respectively on the extension arms 418 of the lamp cover 414 at the pivot portions 423 by, e.g., pivot bolts. The actuating portions 421 of the retaining arms 42 are disposed outwardly of the first body unit 41. The tips (424*a*) of the resilient portions 425 of the retaining arms 42 face toward the first body unit 41 and toward each other, e.g., in such a manner that the tips (424*a*) abut respectively against two opposite sides of the light module holder 417. The distal ends (422*a*) of the positioning projection units 422 also face toward the first body unit 11 and toward each other. The positioning projection units 422 are disposed respectively in two opposite sides of the cavity 410 in the second side 412 of the first body unit 41. Since the retaining arms 42 are pivotable, when the actuating portions 421 are pressed toward the first body unit 41, the positioning projection units 422 are moved away from the first body unit 41.

The second body module 6 includes a second body unit 61, a pair of positioning groove units 62, and a conductive connector 63. The structures of the second body unit 61 and the conductive connector 63 are similar to those of the previous embodiment. Unlike the previous embodiment, each of the positioning groove units 62 includes a plurality of positioning grooves 621 arranged along the axial direction 613 and configured as circular holes, each engageable with the corresponding positioning projection unit 422.

Figure 13:
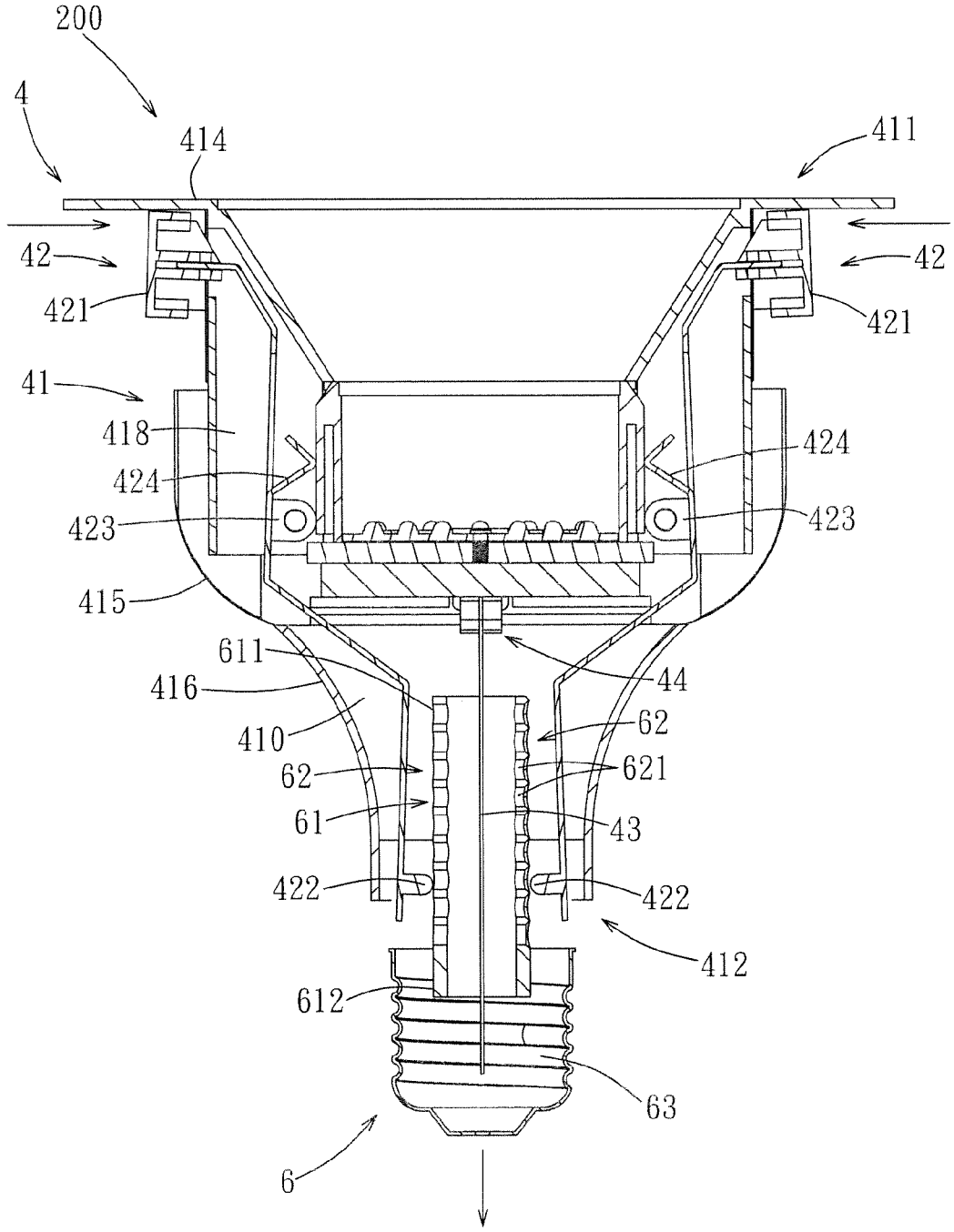
FIG. 13 is a view similar to FIG. 12, illustrating how the retaining arms are operated to remove positioning projection units from positioning groove units so as to allow for relative telescopic movement between first and second body modules.

With particular reference to FIGS. 12 and 13, when the first end 611 of the second body unit 61 is inserted into the cavity 410 in the first body unit 41 to assemble the second body module 6 to the first body module 4, the positioning projection units 422 engage respectively two of the positioning grooves 621. To adjust the height of the luminaire 200 (i.e., move the second end 612 of the second body unit 61 toward or away from the first body unit 41), the actuating portions 421 of the retaining arms 42 are pressed toward each other (i.e., toward the first body unit 41) to remove the positioning projection units 422 from the two positioning grooves 621, respectively. Hence, the second body unit 61 can be moved telescopically relative to the first body unit 41 to adjust the height of the luminaire 200. During such a height adjustment, when the actuating portions 421 are pressed, the resilient portions 424 of the retaining arms 42 are clamped between the arm bodies 420 and the light module holder 417 to deform. When the second body unit 61 is moved relative to the first body unit 41 to a desired height, the actuating portions 421 of the retaining arms 42 are released so that, by virtue of the return force of the resilient portions 424, the positioning projection units 422 are biased into two of the positioning grooves 621 corresponding to the desired height, thereby preventing relative telescopic movement between the first and second body units 41, 61.

As such, in the second preferred embodiment, the two retaining arms 42 can cooperate with the positioning groove units 62 to position the second body unit 61 relative to the first body unit 41.

The light module 5, the light module holder 417, and the heat sink 415 can be interconnected removably in the same manner as the first preferred embodiment.

In view of the above, the length of a portion of the wire 13, 43 disposed outwardly of the wire-receiving unit 14, 44 can be adjusted automatically to prevent wire entanglement. Furthermore, through cooperation of the positioning projection units 12 or the retaining arms 42 of the first body module 1, 4 with the second body unit 61 of the second body module 3, 6, the second body module 3, 6 is movable relative to the first body module 1, 4 to adjust the length of the luminaire 100, 200. Thus, the objects of this invention are achieved. Further, an assembly of the light module holder 117, 417 and the light module 2, 5 is removable from the remaining portion of the luminaire 100, 200 for replacing the light module 2, 6.

With this invention thus explained, it is apparent that numerous modifications and variations can be made without departing from the scope and spirit of this invention. It is therefore intended that this invention be limited only as indicated by the appended claims.

We claim:

1. A luminaire comprising:

a first body module including a first body unit;

a light module disposed on said first body module;

a second body module including a second body unit, and a conductive connector disposed on said second body unit, said second body unit being connected telescopically to said first body unit;

a wire-receiving unit disposed on said first body module; and a wire having two ends respectively and electrically connected to said light module and said conductive connector, said wire having a portion that is received within said wire-receiving unit and that is moved at least partially into or out of said wire-receiving unit as a result of a relative telescopic movement between said first and second body units;

wherein:

said first body unit has opposite first and second sides, said second side is formed with a cavity, said first body module further includes a pair of positioning projection units that are disposed on said first body unit and that extend into said cavity, and said second body module further includes a pair of positioning groove units formed respectively in two opposite sides of said second body unit, said second body unit partially extending into said cavity in said first body unit, each of said positioning groove units including a plurality of positioning grooves, each of said positioning projection units being operable to move into a selected one of said positioning grooves in a corresponding one of said positioning groove units to arrest the relative telescopic movement between said first and second body units; and;

wherein each of said positioning projection units includes, a projecting rod having an end extending into said cavity, and a resilient member disposed in said first body unit for biasing said end of said projecting rod to move into said cavity.

2. The luminaire as claimed in claim 1, wherein said wire-receiving unit includes a torsion spring, said portion of said wire being wound around said torsion spring.

3. The luminaire as claimed in claim 2, wherein said wire-receiving unit further includes a shaft rod disposed fixedly on said first body module, said torsion spring having an inner end fastened to said shaft rod.

4. The luminaire as claimed in claim 1, wherein said first body unit includes a base and a light module holder connected to said base, said light module being disposed on said light module holder and within said first body unit and being adapted for emitting light toward said first side, said cavity being formed in said base.

5. The luminaire as claimed in claim 4, wherein said light module holder includes a holder bottom wall and a holder surrounding wall connected to said holder bottom wall and cooperating with said holder bottom wall to define an accommodating space, said light module being disposed on said holder bottom wall and within said accommodating space.

6. The luminaire as claimed in claim 5, wherein said first body unit further includes a heat sink connected removably to said light module holder, said heat sink including a heat sink bottom wall disposed between said base and said light module holder, a heat sink peripheral wall connected to said heat sink bottom wall and surrounding said light module holder, and a plurality of heat dissipating fins extending radially and outwardly from said heat sink peripheral wall, said heat sink bottom wall having a bottom side facing away from said light module holder, said wire-receiving unit being disposed on said bottom side of said heat sink bottom wall.

7. The luminaire as claimed in claim 6, wherein said light module includes a circuit board, at least one light-emitting member disposed on said circuit board, and a plug connector disposed on said circuit board and outwardly of said holder bottom wall of said light module holder, said heat sink further including a socket connector disposed on said heat sink bottom wall of said heat sink, electrically connected to said wire, and permitting said plug connector to be inserted thereinto.

8. A luminaire comprising:

a first body module including a first body unit;

a light module disposed on said first body module;

a second body module including a second body unit, and a conductive connector disposed on said second body unit, said second body unit being connected telescopically to said first body unit;

a wire-receiving unit disposed on said first body module; and a wire having two ends respectively and electrically connected to said light module and said conductive connector, said wire having a portion that is received within said wire-receiving unit and that is moved at least partially into or out of said wire-receiving unit as a result of a relative telescopic movement between said first and second body units;

wherein said first body unit has opposite first and second sides, said second side is formed with a cavity, said first body module further includes a pair of positioning projection units that are disposed on said first body unit and that extend into said cavity, and said second body module further includes a pair of positioning groove units formed respectively in two opposite sides of said second body unit, said second body unit partially extending into said cavity in said first body unit, each of said positioning groove units including a plurality of positioning grooves, each of said positioning projection units being operable to move into a selected one of said positioning grooves in a corresponding one of said positioning groove units to arrest the relative telescopic movement between said first and second body units; and;

said luminaire further comprising a pair of retaining arms, each of which includes:

an arm body having an end permitting a corresponding one of said positioning projection units to be disposed thereon;

an actuating portion disposed on an opposite end of said arm body;

a pivot portion disposed on said arm body and between the corresponding one of said positioning projection units and said actuating portion and disposed pivotally on said first body unit; and said actuating portions of said retailing arms can be pressed to remove said positioning projection units from said positioning grooves so as to allow for the relative telescopic movement between said first and second body units.

9. The luminaire as claimed in claim 8, wherein said wire-receiving unit includes a torsion spring, said portion of said wire being wound around said torsion spring.

10. The luminaire as claimed in claim 9, wherein said wire-receiving unit further includes a shaft rod disposed fixedly on said first body module, said torsion spring having an inner end fastened to said shaft rod.

11. The luminaire as claimed in claim 8, wherein each of said retaining arms further includes a resilient portion connected to said arm body and disposed between said actuating portion and said pivot portion, each of said positioning projection units being biased by said resilient portion of a corresponding one of said retaining arms to engage the selected one of said positioning grooves in the corresponding one of said positioning groove units.

12. The luminaire as claimed in claim 11, wherein said resilient portion of each of said retaining arms is V-shaped, and has a tip, said retaining arms being disposed respectively and pivotally on two opposite sides of said first body unit, said tips of said resilient portions of said retaining arms abutting against said first body unit.

13. The luminaire as claimed in claim 8, wherein said actuating portion of each of said retaining arms is configured as a pushbutton, and each of said positioning projection units is configured as a projecting rod.

14. The luminaire as claimed in claim 8, wherein said first body unit includes a base and a light module holder connected to said base, said light module being disposed on said light module holder and within said first body unit and being adapted for emitting light toward said first side, said cavity being formed in said base.

15. The luminaire as claimed in claim 14, wherein said first body unit further includes a lamp cover defining said first side, said light module holder being disposed between said base and said lamp cover, said lamp cover having two spaced-apart extension arms, said retaining arms being disposed respectively and pivotally on said extension arms.

16. The luminaire as claimed in claim 14, wherein said first body unit further includes a heat sink connected removably to said light module holder, said heat sink including a heat sink bottom wall disposed between said base and said light module holder, a heat sink peripheral wall connected to said heat sink bottom wall and surrounding said light module holder, and a plurality of heat dissipating fins extending radially and outwardly from said heat sink peripheral wall, said heat sink bottom wall having a bottom side facing away from said light module holder, said wire-receiving unit being disposed on said bottom side of said heat sink bottom wall.

17. The luminaire as claimed in claim 16, wherein said light module holder includes a holder bottom wall, said light module includes a circuit board, at least one light-emitting member disposed on said circuit board, and a plug connector disposed on said circuit board and outwardly of said holder bottom wall of said light module holder, said heat sink further including a socket connector disposed on said heat sink bottom wall of said heat sink, electrically connected to said wire, and permitting said plug connector to be inserted thereinto.

18. A luminaire comprising:

a first body module including a first body unit;

a light module disposed on said first body module;

a second body module including a second body unit, and a conductive connector disposed on said second body unit, said second body unit being connected telescopically to said first body unit;

a wire-receiving unit disposed on said first body module; and a wire having two ends respectively and electrically connected to said light module and said conductive connector, said wire having a portion that is received within said wire-receiving unit and that is moved at least partially into or out of said wire-receiving unit as a result of a relative telescopic movement between said first and second body units;

wherein said first body unit has opposite first and second sides, said second side is formed with a cavity, said first body module further includes a pair of positioning projection units that are disposed on said first body unit and that extend into said cavity, and said second body module further includes a pair of positioning groove units formed respectively in two opposite sides of said second body unit, said second body unit partially extending into said cavity in said first body unit, each of said positioning groove units including a plurality of positioning grooves, each of said positioning projection units being operable to move into a selected one of said positioning grooves in a corresponding one of said positioning groove units to arrest the relative telescopic movement between said first and second body units;

said second body unit has a first end and a second end opposite to each other along an axial direction, said positioning grooves in each of said positioning groove units being arranged in said second body unit along the axial direction; and said second body unit is configured as a tube, each of said positioning grooves extending along a circumferential direction of said tube, each of said positioning groove units further including a slide slot that is in spatial communication with said positioning grooves such that, during the relative telescopic movement between said first and second body units, a corresponding one of said positioning projection units moves in said slide slot in a corresponding one of said positioning groove units, each of said positioning projection units being movable from said slide slot in a corresponding one of said positioning grooves into the selected one of said positioning grooves in the corresponding one of said positioning grooves by rotating said second body unit relative to said first body unit.

19. The luminaire as claimed in claim 18, wherein said wire-receiving unit includes a torsion spring, said portion of said wire being wound around said torsion spring.

20. The luminaire as claimed in claim 19, wherein said wire-receiving unit further includes a shaft rod disposed fixedly on said first body module, said torsion spring having an inner end fastened to said shaft rod.

* * * * *